US005853236A

United States Patent [19]

Rogers et al.

[11] Patent Number: 5,853,236

[45] Date of Patent: Dec. 29, 1998

[54] DESKTOP RACEWAY

[75] Inventors: Wilfred R. Rogers, Bristol; Salvatore A. Cancellieri, Plainville, both of Conn.

[73] Assignee: The Wiremold Company, West Hartford, Conn.

[21] Appl. No.: 724,351

[22] Filed: Oct. 1, 1996

[51] Int. Cl.[6] ..... A47B 81/00

[52] U.S. Cl. ..... 312/223.6; 312/328; 312/242

[58] Field of Search ..... 312/223.6, 223.1, 312/196, 327, 242, 328, 194

[56] References Cited

U.S. PATENT DOCUMENTS

| | | | |
|---|---|---|---|
| 4,094,561 | 6/1978 | Wolff et al. | 312/223.6 |
| 4,296,981 | 10/1981 | Hildebrandt et al. | 312/223.6 X |
| 4,323,291 | 4/1982 | Ball | 312/194 |
| 4,372,629 | 2/1983 | Propst et al. | 312/194 X |
| 5,160,188 | 11/1992 | Rorke et al. | 312/196 |
| 5,255,965 | 10/1993 | Chen et al. | 312/328 X |
| 5,429,431 | 7/1995 | Olson et al. | 312/223.6 |

FOREIGN PATENT DOCUMENTS

| | | | |
|---|---|---|---|
| 002945726 | 5/1981 | Denmark | 312/223.6 |
| 0581975 | 11/1976 | Switzerland | 312/223.6 |

*Primary Examiner*—Peter M. Cuomo
*Assistant Examiner*—Stephen Vu
*Attorney, Agent, or Firm*—McCormick, Paulding & Huber

[57] ABSTRACT

An office coral has a wall that supports a desktop on which various items of office equipment are to be connected with power and data communication cables within the coral structure. A desktop raceway is secured to the wall or desk top and defines both a wireway for the connecting cables and a storage facility for the cabling normally provided on the equipment. The raceway is made up of two generally L-shaped extrusions, one a back plate, the second a cover. The cover has a front panel that defines a slot in cooperation with the back plate's lower edge. A wireway is provided inside the cover adjacent its top panel, and cabling storing or wrapping clips are provided on both the back plates and inside the cover.

14 Claims, 5 Drawing Sheets

DESKTOP RACEWAY

BACKGROUND OF THE INVENTION

The present invention relates to work space or coral type work environments, and deals more particularly with an improved desk top raceway for mounting to a partition wall immediately above the desk top to accommodate the wiring associated with various items of equipment provided on the desk top, as for example, a computer terminal, computer keyboard, computer monitor, telephone, printer and other related items of office equipment generally. Alternatively, the desk top raceway may be mounted directly to the desk top itself.

Various prior art solutions to this problem of accommodating the wiring associated with such items of office equipment have been proposed for use at the rear edge of a desk top. U.S. Pat. No. 4,094,561 shows a channel-shaped raceway, having longitudinally extending slots provided with a resilient skirt so that wiring can be accommodated in the raceway.

U.S. Pat. No. 4,372,629 shows a somewhat similar arrangement wherein a channel-shaped raceway is provided with a brush-like element in the same position as that occupied by the skirt in the above-mentioned U.S. Pat. No. 4,094,561.

Thus, the general concept of providing a longitudinally extending slot in a partition wall or structure at the rear edge of a desk is known. However, the combination of accommodating both such wiring and the connectors provided at the ends of such wiring in these prior art patents does not appear to be suggested.

SUMMARY OF THE INVENTION

It is an object of the present invention to provide a clean raceway at the rear of a desk top mounted in a coral or office partition, and to include a cover for the raceway that can be conveniently raised to provide access to electrical outlets and/or other connections so that both the wiring associated with the office equipment on the desk top is accommodated, and in addition, very unobtrusive access is provided for cable connections within the raceway itself.

This object of the invention is accomplished by providing a desk top raceway which includes a horizontally extending back plate, and a cover of L-shaped configuration pivotably connected to the upper marginal edge of the back plate and movable between normal and raised positions. The front panel of the cover has a lower marginal edge that cooperates with the lower marginal edge of the back plate to define at least one slot, and the cover preferably includes both electrical outlets and computer cable connections on the inside surface of the cover itself to provide a convenient means for linking the cables associated with the office equipment on the desk top to the electrical and data communications wiring provided in the office partition wall to which the desk top raceway is mounted.

DESCRIPTION OF THE EMBODIMENT ILLUSTRATED IN FIGS. 1–3

Figure 2:
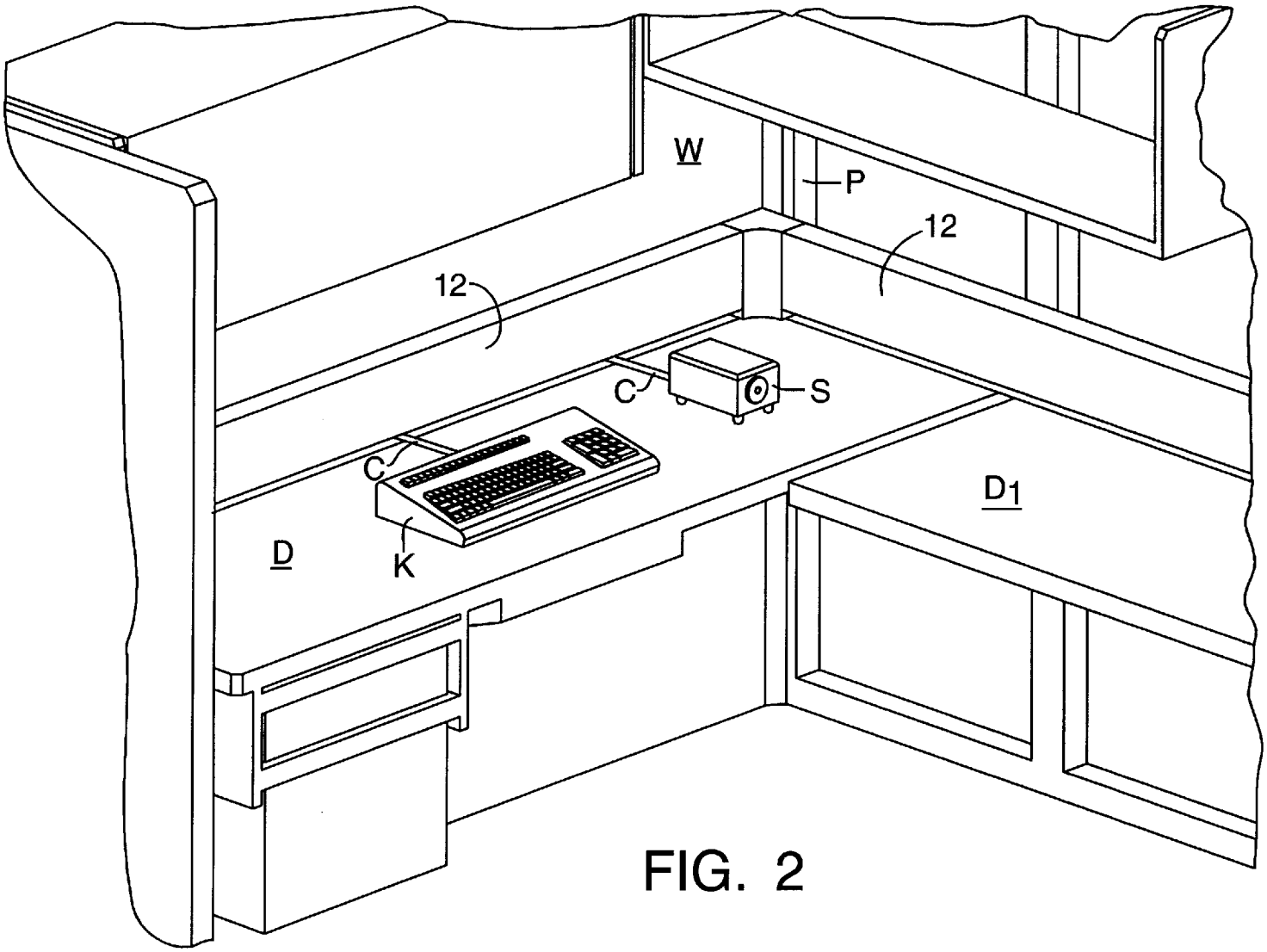
FIG. 2 is a perspective view of a typical office space or coral provided with an improved desk top raceway in accordance with the present invention.

FIG. 2 shows the present invention provided in the environment of an office coral. Relatively low partition walls are provided to form the environment for the office worker and on one or more of these walls W, a desk top raceway is provided in accordance with the present invention. The partition wall W also supports a desk top D mounted in a conventional fashion to the wall, as by brackets or the like (not shown). The partition wall W and/or the upright vertical supports P provided at the corners of the coral include wiring for providing power to the office equipment on the desk top and also serve to provide a data communications link to other workstations (not shown) all in accordance with conventional practice.

For purposes of example, FIG. 2 illustrates a computer keyboard K provided on the desktop D and a pencil sharpener P provided alongside the keyboard. Typically, and as shown by way of example in FIG. 6, a computer monitor M and telephone T would also be provided on the desktop D or on an adjacent desktop such as that illustrated at $D_1$ in FIG. 2. All of these items of office equipment require power and/or communication cable connection with corresponding cables and power lines provided within the wall W or upright post P. By way of example, such cabling is illustrated at C in FIGS. 2 and 6. The ends of such cables being provided within a cavity defined by the desktop raceway to be described.

Figure 1:
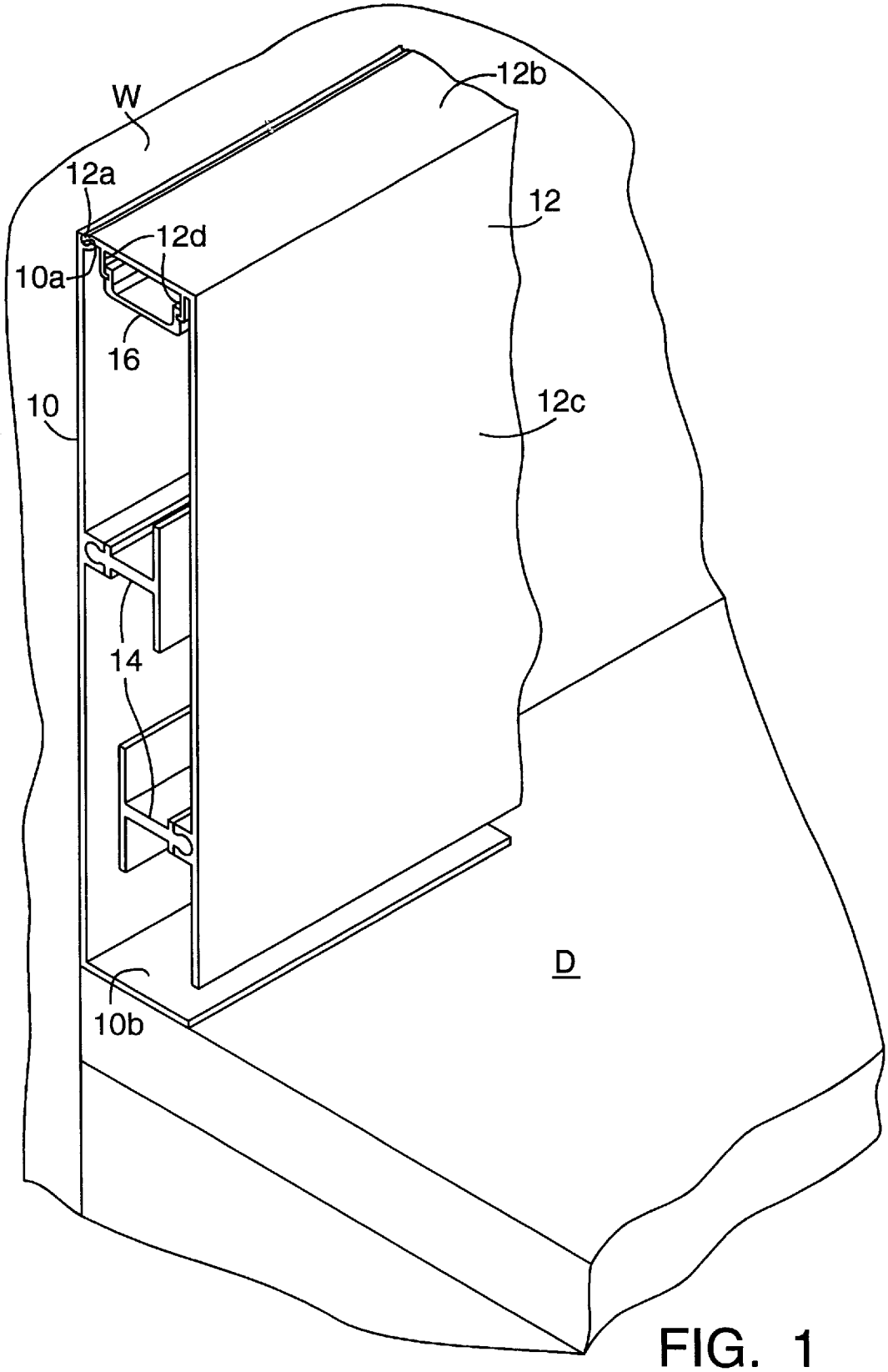
FIG. 1 is a perspective view illustrating in vertical section, and with portions broken away, a desk top and adjacent partition wall that provides the location for mounting of a desk top raceway constructed in accordance with the present invention.
Figure 3:
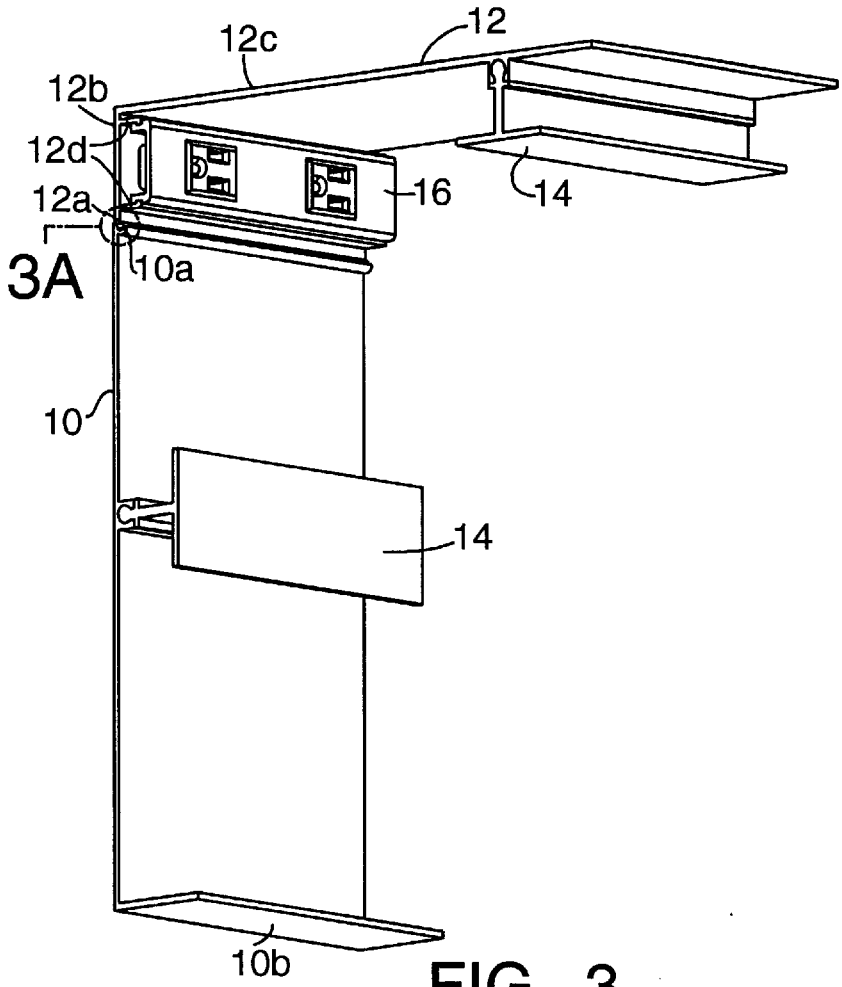
FIG. 3 is a perspective view of the desk top raceway of FIG. 1 with the cover in its raised position, FIG. 1 illustrating the cover in its normal position.
Figure 3A:
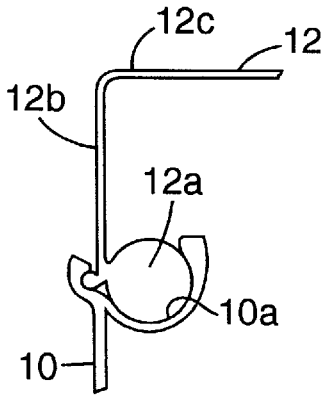
FIG. 3A is a vertical section taken generally in the area designated at 10A in FIG. 3 and showing a portion of the cover in the raised position corresponding to that of FIG. 3.
Figure 3B:
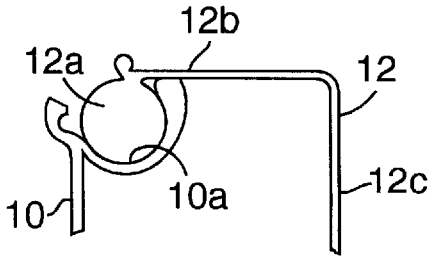
FIG. 3B is a view similar to FIG. 3A but showing the cover in its normal position.

Turning now to FIGS. 1 and 3 in greater detail, the desktop raceway of the present invention includes a back plate 10 which is adapted to be secured to or may actually comprise a part of the wall of the office coral. The back plate 10 includes a lower flange 10*b*. An upper marginal edge opposite the lower flange 10*b* defines a socket as best shown in FIGS. 3*a* and 3*b*, and illustrated at 10*a* in FIGS. 1 and 3, to provide a longitudinally extending socket for a lip 12*a* at the rear upper marginal edge of cover 12.

Thus, the back plate comprises a generally L-shaped member when seen in cross section as per FIG. 1. The back plate 10 preferably includes a further socket defining portion midway between its lower and its upper marginal edges to support segmented cord storing devices such as that illustrated at 14 in FIG. 1. These devices may be inserted in longitudinally spaced relationship in the extruded socket or groove provided in the back plate and are preferably T-shaped in cross section so as to afford a suitably shaped clip device for wrapping cable or the like in a hidden fashion within the desk top raceway.

Turning now to a more complete description of the hinged cover 12, the upper marginal edge 12*a* is received in the elongated socket defining extrusion 10*a* provided at the upper edge of the base plate 10. An interference fit is preferably provided in this region so as to securely hold the cover 12 in either the normal position shown for it in FIG. 1 or for supporting the cover 12 in the raised position illustrated for it in FIG. 3. FIGS. 3*a* and 3*b* illustrate the details of this pivoted connection provided between the back plate 10 and the cover 12.

Still with reference to the cover 12, it will be apparent that this element of the desk top raceway is also L-shaped in vertical section and includes an upper or top panel 12*b* that cooperates with the front panel 12*c* to define this L-shaped configuration. The underside or backside of the front panel is 12*c* of this cover 12 preferably includes a longitudinally extending extruded socket portion that is adapted to receive wire storing or wrapping clips 14 identical to that described previously with reference to the back plate 10.

The cover 12 in the raised position illustrated in FIG. 3 provides the top panel 12*b* in a vertical or near vertical position exposing a channel shaped component with openings that provide access to electrical outlets or other connective devices suitable for data communication or telephone hook ups. This channel component 16 is secured to the back side of top panel 12*b* of cover 12 by reason of spaced depending legs 12*d* provided for this purpose on the back side of the panel 12*b* of the cover 12. This geometry provides an elongated wireway to receive power cords and data communication cabling within the desk top raceway, and more particularly, within a small wireway provided specifically for that purpose and defined in part by the cover 12 and in part by the channel component 16 that is secured to the underside of the cover.

By way of summary, it should be noted that the desktop raceway of the present invention provides a convenient wireway for cabling in the form of power leads and data communication cabling to and from various items of office equipment provided on the desktop itself. This desktop raceway also provides a convenient storage space for surplus cabling such as normally provided on items of office equipment. The slot defined between the lower edge of the cover 12 and the lower lip 10*b* of the back plate serves to provide access at various locations for connection with the items of equipment as best illustrated in FIG. 2.

DETAILED DESCRIPTION OF THE EMBODIMENT ILLUSTRATED IN FIGS. 4–6

Figure 5:
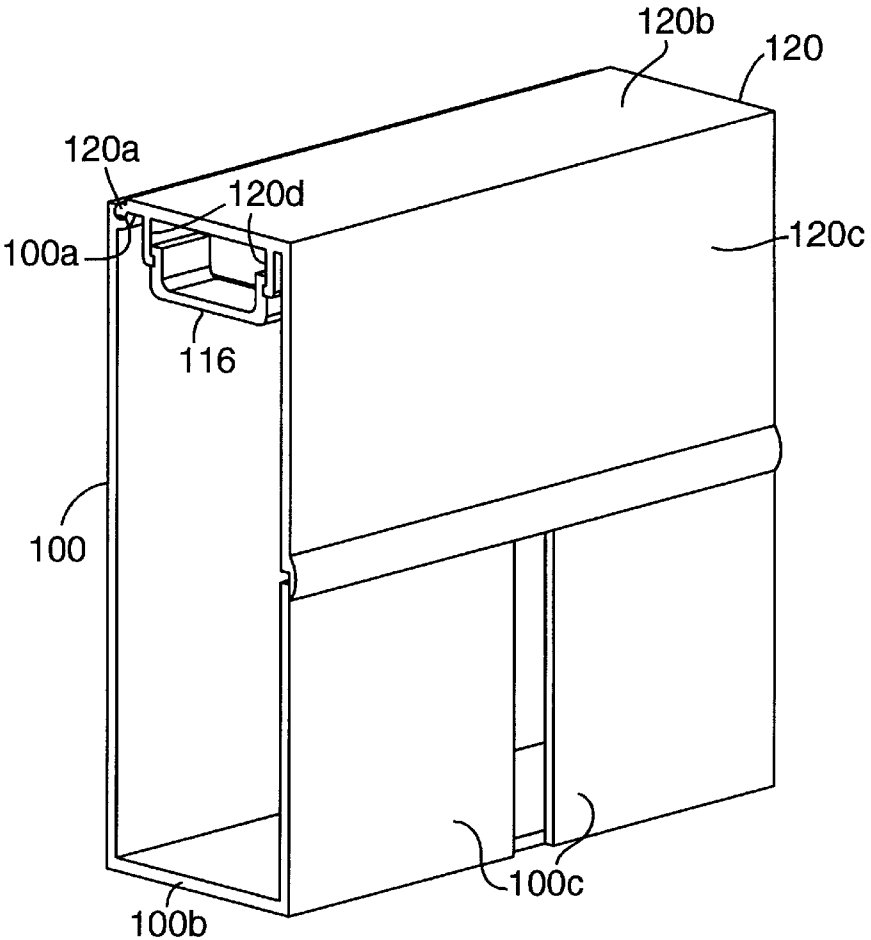
FIG. 5 is a view similar to FIG. 4 but illustrating the cover in its normal position.
Figure 4:
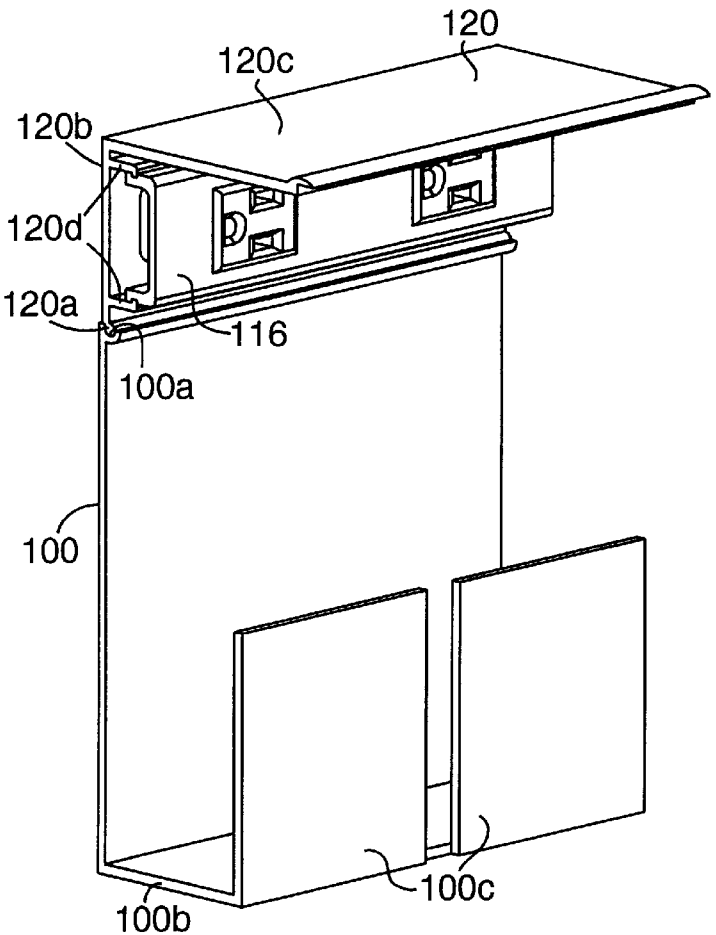
FIG. 4 shows a desk top raceway of alternative configuration with a somewhat less obtrusive cover, and with the base defining vertically extending segments that define spaced slots, rather than the elongated horizontal slot as shown in FIG. 1.
Figure 6:
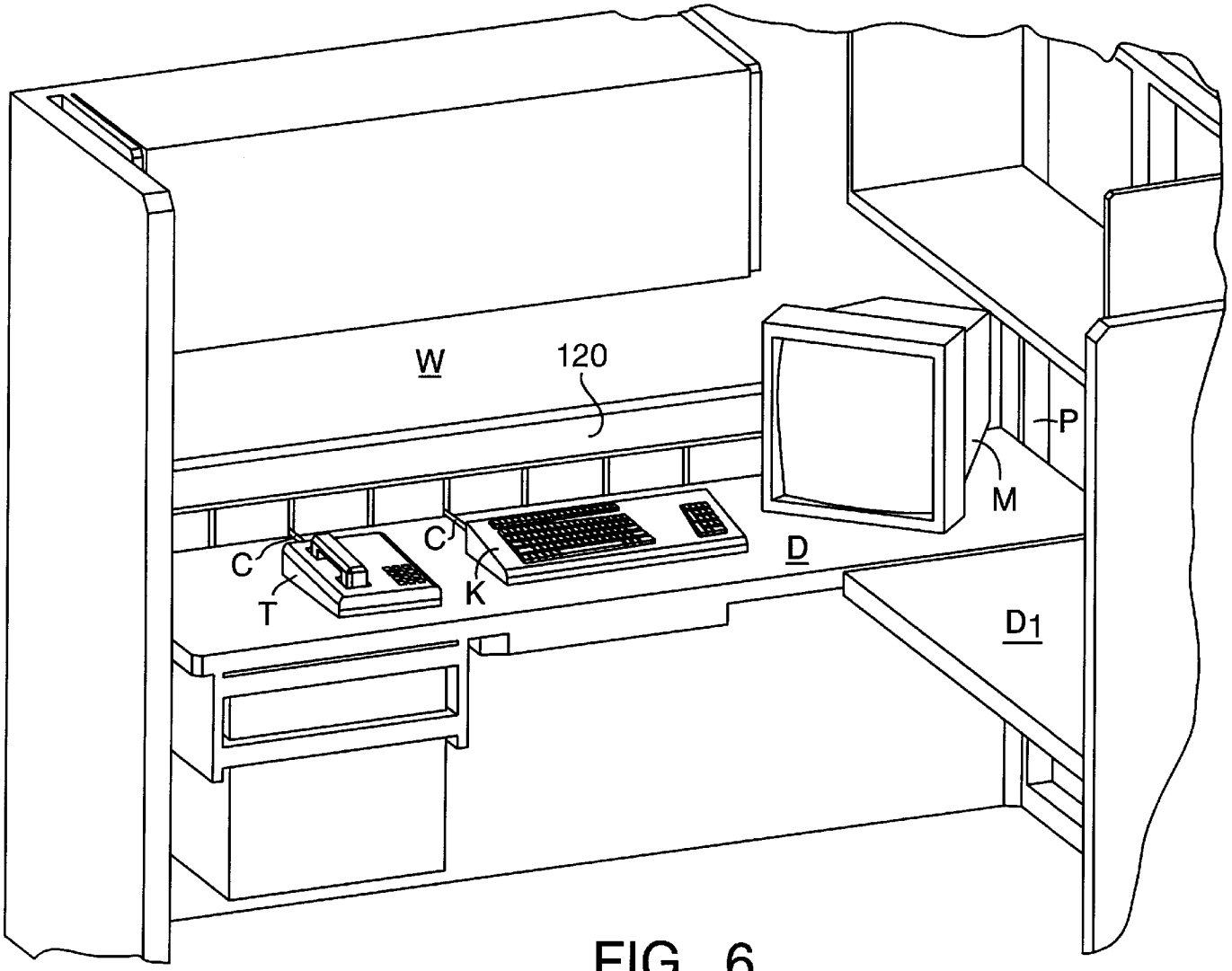
FIG. 6 is an overall perspective view illustrating the desk top raceway of FIGS. 4 and 5 provided in a typical office coral environment.

FIG. 4 illustrates an alternative embodiment for a desktop raceway constructed in accordance with the present invention, and instead of an elongated slot provided continuously along the raceway as is achieved in the embodiment of FIGS. 1–3 inclusively, the raceway of FIGS. 4, 5, and 6 comprises a cover 120 which is similarly hinged to the back plate 100, but which provides a different geometry for the slot configuration for accommodating the cabling. The upper edge of the back plate 100 defines a longitudinally extending socket 100*a* that pivotably receives the upper marginal edge 120*a* of the cover 120 as described previously with reference to the socket 100*a* in the back plate of the embodiment of FIGS. 1–3. Also, the cover 120 includes a top panel 120*b* that defines depending legs 120*d* for receiving a channel shaped component 116 that cooperates with the back of the cover top panel to define a wireway. This channel component defines openings for providing access to electrical outlets or other connective devices to allow cable connections with equipment provided on the desk top. As in the previously described embodiment, portions of the cabling associated with the desk top equipment can be conveniently stored within the cavity defined by the desktop cover and back plate, 120 and 100 respectively. However, rather than providing a longitudinally extending continuous slot between the lower edges of these components, the embodiment of FIGS. 4–6 provides a series of vertically extending slot segments between upstanding panel segments 100*c* that are integrally formed with the lower flange 100*b* of the back plate 100. FIG. 5 shows these slot segments to best advantage where the cover front panel 120*c* has a lower edge that overlies the upper edges of these front panel segments 100*c* for this purpose.

FIG. 6 shows the desktop raceway of FIGS. 4 and 5 mounted on the wall W in a typical office coral so as to afford a convenient storage facility for the cabling c,c associated with various items of office equipment provided on the desktop D.

We claim:

1. A Desktop Raceway comprising:

a horizontally extending back plate having upper and lower marginal edges;

a cover for said back plate, said cover being generally L-shaped in vertical section with integrally formed top and front panels; said cover top panel including depending ribs, a channel shaped component having an elongated U-shape configuration with upstanding legs secured to said ribs and cooperating with said cover top panel to define a wireway therebetween, said top panel having a marginal edge pivotably connected to said upper marginal edge of said back plate and being movable between closed and open positions;

said front panel having a lower marginal edge cooperable with said lower marginal edge of said back plate to define at least one slot; said back plate and cover defining a rear marginal edge of said back plate and said upper marginal edge of said cover defining integrally formed pivotal elements, one of said elements comprising a longitudinally extending cylindrical shape, the other of said elements defining a rear marginal edge socket whereby said cover in its closed position cooperates with said back plate to define a cavity therebetween, and said slot being open into said cavity for accommodating cabling associated with equipment provided on the desktop.

2. The desktop raceway according to claim 1, wherein said back plate further includes an elongated second socket oriented parallel said rear marginal socket, and wire wrapping clips releasably retained at spaced locations in said second socket.

3. The desktop raceway according to claim 2, wherein said back plate defines a lower forwardly projecting flange so that it too has a generally L-shape complementing the L-shape of said cover to define an elongated cavity of generally rectangular shape therebetween, said cavity being forwardly exposed when said cover is open.

4. The desktop raceway according to claim 3, wherein said back plate further includes front panel segments connected to said lower flange and slot segments defined between said panel segments.

5. The desktop raceway according to claim 4, wherein said cover upper marginal edge is generally of cylindrical shape so as to be pivotably supported in said rear marginal edge socket.

6. A desk top raceway comprising:

a horizontally extending back plate having a lower forwardly projecting flange, a cover for said back plate, said cover being generally L-shaped in vertical section with integrally formed top and front panels, said top panel of said cover being movably connected to an upper marginal edge of said back plate for closing and opening a cavity defined between said back plate and said cover, said front panel of said cover having a lower marginal edge cooperating with said forwardly projecting flange of said back plate to define at least one slot, whereby said cover not only cooperates with said back plate so as to define a cavity therebetween, but also provides access to that cavity for the cabling associated with equipment on the desk top by reason of said at least one slot, and a channel-shaped component having longitudinally extending legs secured to the underside of said cover top panel and defining a hidden wireway that is accessible when said cover is open.

7. The desk top raceway according to claim 6, wherein said wireway defining channel includes longitudinally spaced openings for receiving electrical outlet plugs.

8. The desk top raceway according to claim 7, wherein said back plate has a rear marginal edge socket for pivotably receiving an upper marginal edge of said cover top panel.

9. The desk top raceway according to claim 8, wherein said cover top panel includes longitudinally extending ribs, and wherein said channel legs are received by said ribs.

10. The desk top raceway according to claim 9, wherein said rear marginal edge socket is so configured that said cover is releasably retained in said open position.

11. The desk top raceway according to claim 9, wherein said cover further includes a second elongated socket oriented parallel said rear marginal edge socket and wire wrapping clips releasably retained at spaced locations in said second socket.

12. The desk top raceway according to claim 9, wherein said back plate further defines a second socket oriented parallel said rear marginal edge socket, and wire wrapping clips releasably retained at spaced locations in said second socket.

13. The desk top raceway according to claim 12, wherein said back plate further includes front panel segments connected to said lower flange, and slots defined between said panel segments, whereby a plurality of slots are provided for accommodating cabling or the like, said slots being oriented vertically relative to the desk top.

14. The desk top raceway according to claim 9, wherein said back plate forwardly projecting flange cooperates with a horizontally extending back panel of said back plate to define a generally L-shape, said L-shaped back plate complementing the L-shape of said cover to define an elongated cavity of generally rectangular shape therebetween, said cavity being forwardly exposed when said cover is open, and said slot being defined between said back plate forwardly projecting flange and the lower marginal edge of said cover once said cover is closed.

* * * * *